US006467314B1

(12) United States Patent
Zaglio

(10) Patent No.: US 6,467,314 B1
(45) Date of Patent: Oct. 22, 2002

(54) METHOD AND APPARATUS FOR PAIRING THREADS IN TEXTILE MACHINE

(75) Inventor: Sergio Zaglio, Castiglione delle Stiviere (IT)

(73) Assignee: Memminger-IRO GmbH (DE)

( * ) Notice: Subject to any disclaimer, the term of this patent is extended or adjusted under 35 U.S.C. 154(b) by 0 days.

(21) Appl. No.: 09/913,211

(22) PCT Filed: Feb. 2, 2000

(86) PCT No.: PCT/IT00/00034

§ 371 (c)(1),
(2), (4) Date: Oct. 15, 2001

(87) PCT Pub. No.: WO00/47805

PCT Pub. Date: Aug. 17, 2000

(30) Foreign Application Priority Data

| | | |
|---|---|---|
| Feb. 9, 1999 | (IT) | BS99A0010 |
| Mar. 12, 1999 | (IT) | BS99A0022 |
| Oct. 8, 1999 | (IT) | BS99A0094 |

(51) Int. Cl.[7] ..... D04B 15/48
(52) U.S. Cl. ..... 66/125 R; 139/450
(58) Field of Search ..... 139/450, 452; 66/125 A, 172 E, 125 R, 131, 136, 146; 28/248; 57/63, 64

(56) References Cited

U.S. PATENT DOCUMENTS

| | | | | |
|---|---|---|---|---|
| 3,556,029 A | * | 1/1971 | Eigenmann | 112/254 |
| 3,861,176 A | * | 1/1975 | McWhirter et al. | 28/218 |
| 4,256,148 A | | 3/1981 | Scharling, III | |
| 4,335,588 A | * | 6/1982 | Bos | 66/125 A |
| 4,919,172 A | | 4/1990 | Riezler et al. | |
| 5,295,516 A | * | 3/1994 | Tanaka et al. | 139/1 R |
| 5,400,729 A | * | 3/1995 | Bryant | 112/139 |

FOREIGN PATENT DOCUMENTS

| | | |
|---|---|---|
| DE | 1 806 326 | 5/1970 |
| EP | 0 338 201 | 2/1989 |
| FR | 2 376 237 | 7/1978 |

* cited by examiner

*Primary Examiner*—Danny Worrell
(74) *Attorney, Agent, or Firm*—Leydig, Voit & Mayer, Ltd.

(57) ABSTRACT

An apparatus and method for pairing at least two threads for processing in a textile machine. The apparatus includes individual thread feeding devices for furnishing individual threads to a pairing device in which the individual threads are formed into a single resulting paired thread, and a paired thread feeding device, which includes a cylindrical accumulator coaxial with the individual thread feeder devices, for receiving the single resulting paired thread from the paired feed device and delivering the single resulting paired thread, under controlled tension, to the textile machine.

38 Claims, 2 Drawing Sheets

METHOD AND APPARATUS FOR PAIRING THREADS IN TEXTILE MACHINE

FIELD OF THE INVENTION

Figure 1:
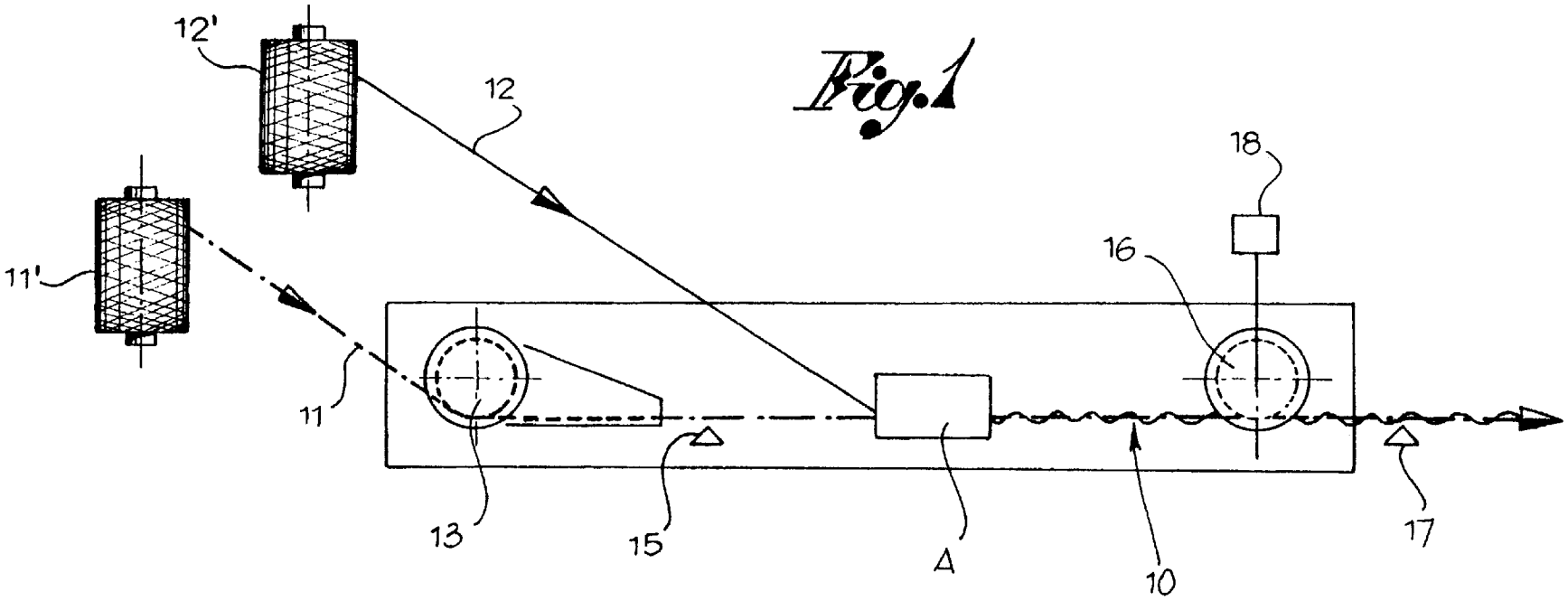

This invention concerns the textile sector and textile machines for knitted goods, hosiery and similar where paired or cabled threads are used to make fabrics, pullovers, socks, etc. More particularly, the invention refers to a method and equipment for pairing two or more threads when entering said machines, by pairing covering, cabling or interlacing of one thread, even an elastic one, which may be taut to a greater or lesser degree, with at least one other thread.

STATE OF THE ART

The processing of certain types of fabrics or pullovers requires the availability and use of paired or cabled threads, consisting of one thread, which may even be elastic, and at least one other thread of natural or synthetic fibre.

Thread pairing is usually carried out by covering one thread with one or more different threads. The pairing may be done with a pneumatic action, blasting a jet of air over the threads, or with other methods. Pairing devices for this pairing operation are already known. However, the operation at present is carried out in special mills, with complex and bulky machinery, taking the threads for pairing from their respective reels, passing them through a twisting machine and rewinding the paired thread on another reel.

FR-A-23767237 discloses a method for processing multifilament yarns on a knitting machine, especially a circular knitting machine, comprising the steps of feeding two or more individual threads to a pairing or cabling device in the form of a texturizing device which forms a single resultant texturized thread thereof that is directly furnished to a knitting point of the knitting machine associated thereto. Since the texturized yarn passes from the texturizing device via a yarn eyelet directly to the knitting point it is difficult to maintain a predetermined yarn tension on the input side of the knitting machine, particularly during start/stop of the knitting machine. Synchronizing the texturising device exactly with the knitting machine is difficult, however.

Something similar is true for a meth2od for manufacturing knitwear that is disclosed in DE-A 180 6326.

THE INVENTION

The first aim of this invention is to use an innovative and orginal way to resolve the problem of pairing or cabling two or more threads which are about to be processed on textile machines used for knitted goods or hosiery; by means of an efficient pairing method and, above all, with significant managerial, practical and economic advantages.

Another objective of this invention is to make and supply a device which, when applied to any textile machine, makes it practical and efficient to operate such a pairing method, as described above of two or more threads, available for imediate. use on the textile machines.

The first objective is achieved with a method of pairing and cabling of two or more threads for use in textile machines for knitted goods and hosiery, according to which the pairing or cabling of the individual threads that will compose the paired or cabled thread takes place is immediately before use, that is, during the use of the paired thread in the machine.

Numerous advantages are to be obtained, including: elimination of machines for the preparation beforehand of paired threads; elimination of warehouse supplies of paired threads; the chance to make thread-users independent of other producers; the immediate availability of paired threads without picking up the reels; the immediate use of paired threads on the textile machines with freedom of choice over the colours, thickness and nature of staring threads, according to the specific needs of the fabrics or knitted work in question; the possibility of direct control in the machine over the drawing of the paired threads and/or re-entry of knitted work after processing, etc.

The second objective of the invention is realised with a pairing or covering device for two or more threads to be processed in textile machines used for knitted goods, hosiery and similar, which includes means for bringing together at least two separate threads, means for stretching and pulling the paired threads, a means for pairing and covering certain threads when leaving said means for pulling and a spinning accumulator for collecting and accumulating the paired or cabled thread when it leaves said pairing means, the textile machine feeding itself independently with paired thread from the said accumulator.

This device is easily applicable to any textile machine and is designed to interact functionally with them all.

In particular, accumulating the paired thread on an accumulator means that the formation of the paired thread is independent of the request for thread made by the machine. In this way, the pairing device can be easily coordinated to satisfy any textile machine, without resorting to structural or functional modifications of the latter.

Furthermore, tanks to its own accumulator, the pairing device does not have any influence on the tension of the paired thread directed towards the textile machine. Thus, the thread can be supplied to the machine either tension-free or with a pre-determined tension, according to requirements, this being controlled by the machine's own means.

The production speed of the paired thread can be regulated and is completely independent from the textile machine's consumption speed of the thread. Correspondingly, the production speed of the paired or cabled thread may be equal to that of the feed speed of the thread to the machine in the case where there is no accumulation of thread on the accumulator and the quantity of tread accumulated remains constant. It is preferable, however, that the production speed of the paired or cabled thread be greater than that of the thread requested by the machine. In this case, the thread is accumulated on the accumulator, between a controlled minimum and maximum, and is at the disposal of the machine to be fed. Consequently, the pairing device will work intermittently, without being strictly tied to the operation and work speed of the machine, and this means lower energy consumption and reduced wear of the equipment.

The availability of thread on the accumulator means regular thread-feeding to the textile machine, whether the latter is operating continuously or not.

Another advantage, by no means least, is that such a device can be used not only for pairing several threads, but also as the feeder of a single elastic thread, which is bare and can be regulated in tension, rather than using the traditional devices that are currently applied to textile machines.

This invention also includes any kind of textile machine for knitted goods and hosiery, fed with paired threads made by the method and with the device according to the invention.

SHORT DESCRIPTION OF THE DRAWINGS

Figure 2:
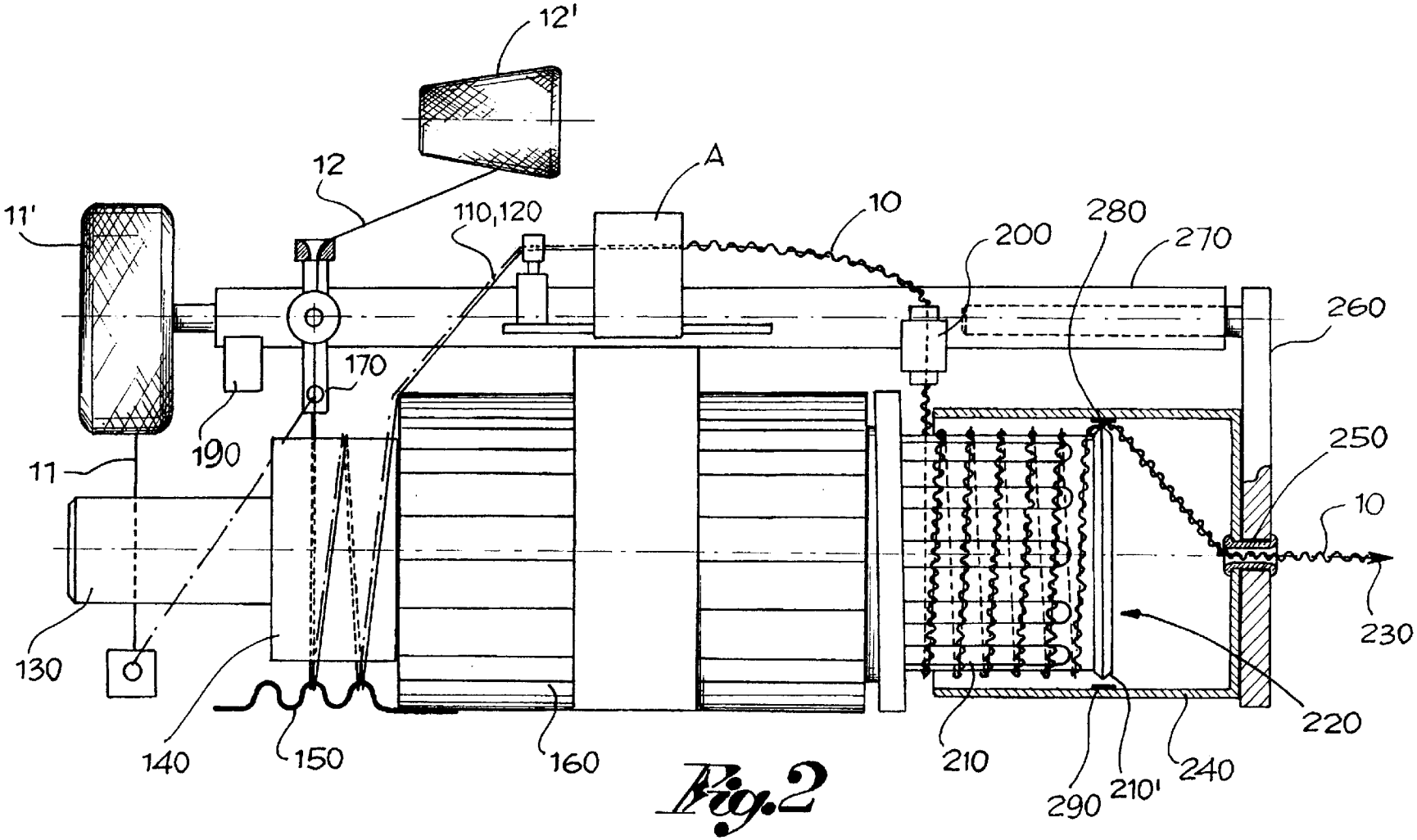

Hereafter, the method and device of the invention shall be described in greater detail and with reference to the enclosed drawings, in which:

FIG. 1 shows the principles of the method and device for pairing two threads; and FIG. 2 shows the best practical way for creating the pairing device.

DETAILED DESCRIPTION OF THE INVENTION

In these drawings, the number 11 indicates a first individual thread, intended for pairing or cabling with at least one second individual thread 12. One of these original starting threads 11, 12 may be elastic, for example the first thread 11, while the other may be natural or synthetic fibre.

The threads 11, 12 originate from their respective sources 11', 12' and are conducted to a pairing device A, which may be of the air-jet type or other known type.

Where necessary, the elastic thread 11 can be pulled taut using a stretcher 13.

The tension of said thread 11, especially if elastic, can be measured and controlled within certain limits by means of a draft sensor 15 and with any other mechanical or electronic means for controlling the drafting and/or feed speed of the thread.

The sting threads 11, 12 leave the device A paired or cabled as a single thread 10, which is conducted to a pulling out device 16, which sends it directly to be used—in this case—by a textile machine for knitted goods or hosiery.

The tension of the paired thread 10, destined for immediate use, can also be measured and controlled by using an appropriate draft sensor 17, or other means. Either or both the means for pulling 13 and expelling 16 may be rotating, driven by a motor 18, operating at various speeds according to the signals sent by one or both draft sensors 15, 17, and which starts up and stops according to a signal from the user machine, which may or may not require more paired thread.

Alternatively, the one or more thread-drawing means may be activated by a command shaft deriving from that of the machine and synchronised with it.

FIG. 2 shows the favoured version of the device according to the invention, where a first thread 11 arrives from its source 11' and, if it is elastic and needs drawing, passes round a first roller 130 and is then wound, forming several loops, around a second roller 140, passing onto an undulating or grooved bar 150.

The two rollers 130, 140 may be coaxial and driven by a motor 160. The second roller 140 has a greater diameter than the it roller 130 for drafting the thread 11, as required. Alteniavely, the two rollers may have the same diameter, but operate at different speeds in order to obtain the same drafting results, prior to pairing with the other thread.

Clearly, if the first thread does not need to be drafted, one roller is sufficient.

The second thread 12, arriving from its own source 12', is conducted to and paired with the first thread 11, which has already been drafted where necessary, at the level of a guide plate 170. Then, the two threads 11, 12 are guided into the pairing device A, where they are interlaced in such a way as to form a single thread, indicated by the number 10.

The device also includes a sensor 190 for the presence of the first thread 11 and another sensor 200 for the presence of at least one other second thread 12, said sensors being designed to stop the device and, via this, the machine being fed, when one or other of the threads is finished or breaks.

In any case, the paired or interlaced thread 10 is then wound in a cerrain regulated number of loops upon a spinning cylinder 210 of an accumulator 220, before being re-supplied to the textile machine which is used for knitted goods, hosiery or similar, according to the arrow 230.

The cylinder 210 of the accumulator 220 may be activated by the same motor 170 that powers the rollers 130, 140 and may have a tip 210' at its free end.

The accumulator is operated so as to accumulate a certain quantity of the thread 10, between a pre-established minimum and maximum, and, thereby, keep the thread available for automatic collecting by the textile machine in the course of its operation and according to the job in hand. The cylinder 210 of the accumulator 220 may be enclosed within a protective element, such as a cap or ring 240 which rotates together with the cylinder and has a guide bushing 250 to allow the thread to pass through, towards the textile machine. Said guide bushing 250 is located on the rotational axis of the protective element 240. The latter is carried on a support 260, guided and movable with respect to a fixed body 270, so that it can slide off the cylinder, giving access to the cylinder itself.

The protective element 240 may be fastened in any way, even magnetic, so that it rotates directly with the cylinder 210, as shown in the drawing. Alternatively, it could be driven independently by its own motor, or pulled into rotation by the use of magnets.

In any case, the protective element 240 and the cylinder 210 together define a circular opening 280, through which the thread 10 passes from the cylinder itself to the guide bushing 250 to the exit. The opening 280 is limited in width so as to allow only the passage of the thread 10, but in such a way that the thread does not meet any resistance, which could affect its tension when it is wound upon the cylinder.

On the inside of the element 240, at the height of the cylinder tip 210, there may also be a piece of felt or strip of material 290 which contributes fiter to preventing the loops of thread 10 from detaching from the cylinder and eliminating tugging and tension by said cylinder on the thread, when the latter is requested by the machine being fed.

Therefore, a textile machine for knitted goods, hosiery etc., can be fed at any stage of work with a paired or cabled thread, arriving directly from the pairing or cabling system described above, even if the starting threads originate from separate sources.

I claim:

1. A device for pairing at least two threads for processing on a textile machine for knitted goods, hosiery and similar items, comprising:

a device for furnishing at least one first thread (11) and a second thread (12) and bringing said threads together, a pairing device (A) for said first and second threads to form a single resulting paired thread thereof, and an accumulator device (220) for gathering and accumulating a certain quantity of said single resulting paired thread supplied thereto by said pairing device (A) and for supplying said single resulting paired thread to said textile machine, said accumulator device (220) including a rotatably supported cylinder (210), and a protective containing element (240) encompassing said cylinder (210) and defining with the cylinder (210) a circular opening (280) allowing the passage of said single resulting paired thread from the cylinder (210) to a threaded guide eyelet (250) for direction to said textile machine.

2. A device for pairing at least two threads for processing on a textile machine for knitted goods, hosiery and similar items, comprising:

at least one device for furnishing at least one first thread (11) and a second thread (12) and bringing said threads together, said at least one device including at least one driven roller (130) for supporting windings of at least said first thread (11) coming from a thread source (11') and a second roller (140) on which said first thread (11) is wound for drafting, a pairing device (A) for said first and second threads to form a single resulting paired thread thereof; and an accumulator device (220) for gathering and accumulating a certain quantity of said single resulting paired thread supplied thereto by said pairing device (A), and for supplying said single resulting paired thread to said textile machine.

3. A device for pairing at least two threads for processing on a textile machine for knitted goods, hosiery and similar items, comprising:

a device for furnishing at least one first thread (11) and a second thread (12) and bringing said threads together, a pairing device (A) for said first and second threads to form a single resulting paired thread thereof, a sensor (15; 17) for controlling the feed speed of said threads (11; 10); and an accumulator device (220) for gathering and accumulating a certain quantity of said single resulting paired thread supplied thereto by said pairing device and for supplying, said textile machine being supplied with said single resulting paired thread to said textile machine.

4. A device for pairing at least two threads for processing on a textile machine for knitted goods, hosiery and similar items, comprising:

at least one individual thread feeding device for supplying at least a first individual thread (11) and a second individual thread (12) and bringing said threads together, a pairing device (A) for said individual threads to form a single resulting paired thread;

a paired thread feeding device for receiving said single resulting paired thread from said pairing device and supplying said single resulting paired thread to said textile machine, and said at least one individual thread feeding device and said paired thread feeding device being arranged coaxially to another.

5. Device according to claim 4 wherein said paired thread feeding device is an accumulator device for gathering and accumulating a certain quantity of said single resulting paired thread.

6. Device according to claim 5 wherein the accumulator device comprises a rotating element where said quantity of said single resulting paired thread is wound around.

7. Device according to claim 6 wherein said rotating element is a rotatably supported cylinder (210).

8. Device according to claim 7 wherein said rotatably supported cylinder (210) is enclosed by a protective containing element (240) defining with the cylinder a circular opening (280) allowing the passage of thread from the cylinder to a thread guide eyelet (250) directing the thread to said textile machine.

9. Device according to claim 8, in which said containing element is movable axially to allow it to slide over or off the cylinder (210) of the accumulator.

10. Device according to claim 8, in which said containing element is linked to and pulled around, directly or indirectly, by the rotatable cylinder, said cylinder being driven by a motor.

11. Device according to claim 8 wherein said thread guide eyelet (250) is located on the rotational axis of the cylinder.

12. Device according to claim 8 wherein said thread guide eyelet (250) is located on the rotational axis of the cylinder.

13. Device according to claim 11 wherein said protective element (240) is in the form of a cup or ring.

14. The device according to claim 8 wherein said protective element (240) is drivingly coupled to and rotated, directly or indirectly, by said cylinder.

15. The device according to claim 8 wherein said protective element (240) is driven by a motor.

16. The device according to claim 8 wherein said protective element (240) is drivingly coupled to said cylinder (210) by magnets placed therebetween.

17. Device according to claim 4 wherein said individual thread feeding device comprises at least one rotating element around which at least one of said first and second thread is wound.

18. Device according to claim 17 wherein the rotating element is a driven roller (140).

19. Device according to claim 18 wherein at least two individual threads are wound around said roller (140).

20. Device according to claim 18 comprising a second roller (130) on which said thread (11) is wound for being drafted.

21. The device according to claim 18 wherein the pairing device (A) is arranged downstream of the at least one roller (130) and the single resulting paired thread emerging from said pairing device (A) is fed to said paired thread feeding device (220).

22. Device according to claim 4 wherein at least two of said coaxially arranged feeding devices are driven by the same motor.

23. Device according to claim 4 including a sensor (15; 17) for controlling the feed speed of said threads (11; 10).

24. A method of pairing at least two threads for use in a textile machine for knitted goods, hosiery and similar items, wherein the threads are paired to form a resulting paired thread, said method comprising the steps of:

transporting at least two individual threads to be paired to a pairing device (A) associated with a work station of said textile machine, including passing at least one of said individual threads through at least one individual thread feeding device, pairing said individual threads by said pairing device (A) to form a single resulting paired thread (10) and furnishing said single resulting paired thread (10) to said textile machine at a controlled thread tension, including passing said single resulting paired thread through a paired thread feeding device arranged coaxially with said at least one individual thread feeding device.

25. The method according to claim 24 including accumulating a certain quantity of said single resulting paired thread (10) on said paired thread feeding device before supplying said single resulting paired thread (10) to said textile machine.

26. The method of claim 24 including passing at least one of said individual threads through a tensioning device.

27. The method of claim 24 in which said transporting step includes transferring at least one individual elastic thread.

28. The method according to claim 26 including driving at least one of said thread feeding devices by its own motor.

29. The method of claim 24 including driving at least two of said coaxially arranged feeding devices by a common motor.

30. The method according to claim 24 including intermittently feeding said single resulting paired thread to said textile machine.

31. The method according to claim 25 including driving at least one of said thread feeding devices by a drive of said textile machine.

32. The device according to claim 1 wherein said thread guide eyelet (250) is located on the rotational axis of the cylinder.

33. The device according to claims 32, wherein said protective element (240) is in the form of a cup or ring.

34. The device according to claim 1 wherein said protective element (240) is drivingly coupled to and rotated, directly or indirectly, by said cylinder.

35. The device according to claim 1 wherein said protective element (240) is driven by a motor.

36. The device according to claim 2 wherein said protective element (240) is drivingly coupled to said cylinder (210) by magnets placed therebetween.

37. The device according to claim 2 wherein the two rollers (130, 140) are arranged coaxially to one another.

38. The device according to claim 25 wherein the pairing device (A) is arranged downstream of the at least one roller (130) and the single resulting thread emerging from said pairing device (A) is fed to said accumulator device (220).

* * * * *